US008020955B2

(12) United States Patent
Shibata

(10) Patent No.: US 8,020,955 B2
(45) Date of Patent: Sep. 20, 2011

(54) LIQUID EJECTING APPARATUS AND METHOD OF SETTING SIGNAL FOR MICRO VIBRATION

(75) Inventor: Hitomi Shibata, Shizuoka (JP)

(73) Assignee: Seiko Epson Corporation, Tokyo (JP)

( * ) Notice: Subject to any disclaimer, the term of this patent is extended or adjusted under 35 U.S.C. 154(b) by 125 days.

(21) Appl. No.: 12/403,482

(22) Filed: Mar. 13, 2009

(65) Prior Publication Data

US 2009/0231372 A1 Sep. 17, 2009

(30) Foreign Application Priority Data

Mar. 14, 2008 (JP) ..... 2008-066415

(51) Int. Cl.
*B41J 29/38* (2006.01)
*B41J 2/165* (2006.01)

(52) U.S. Cl. ..... 347/11; 347/27

(58) Field of Classification Search ..... 347/11, 347/27

See application file for complete search history.

(56) References Cited

U.S. PATENT DOCUMENTS 6,283,568 B1 * 9/2001 Horii et al. ..... 347/11
6,450,603 B1 * 9/2002 Chang ..... 347/11
6,715,852 B2 * 4/2004 Yonekubo ..... 347/11
2002/0033852 A1 * 3/2002 Chang ..... 347/9
2004/0021714 A1 * 2/2004 Kitami et al. ..... 347/9
2009/0244135 A1 * 10/2009 Kaieda et al. ..... 347/10

FOREIGN PATENT DOCUMENTS

JP 2000-117993 4/2000
JP 2002-154207 5/2002

* cited by examiner

*Primary Examiner* — Shelby Fidler

(74) *Attorney, Agent, or Firm* — Maschoff Gilmore & Israelsen

(57) ABSTRACT

A liquid ejecting apparatus includes liquid chambers in which a liquid is filled, nozzles communicating with the liquid chambers, a signal generator generating a signal of potential change, and elements operating in accordance with the potential of the signal to be applied to cause a change in pressure in the liquid chambers. The signal generator generates a signal for micro vibration of a free surface of the liquid to be exposed from the nozzles such that the liquid is not ejected. The signal for micro vibration has a first potential change portion at which a potential changes from a first potential to a medium potential between the first potential and a second potential, a subsequent constant potential portion at which the potential is maintained constant at the medium potential, and a subsequent second potential change portion at which the potential changes from the medium potential to the second potential.

5 Claims, 12 Drawing Sheets

FIG. 5A

| SIZE OF DOT TO BE FORMED | DOT FORMING DATA |
|---|---|
| _____ | 00 |
| S | 01 |
| M | 10 |
| L | 11 |

FIG. 5B

| DOT FORMING DATA | PULSE TO BE APPLIED |
|---|---|
| 00 | N |
| 01 | S |
| 10 | M |
| 11 | L |

LIQUID EJECTING APPARATUS AND METHOD OF SETTING SIGNAL FOR MICRO VIBRATION

BACKGROUND

1. Technical Field

The present invention relates to a liquid ejecting apparatus and a method of setting a signal for micro vibration.

As a liquid ejecting apparatus ejecting a liquid, an ink jet type printer is known in which ink droplets are ejected from nozzles. Such an ink jet type printer includes a printer in which ink is prevented from being thickened near the nozzles. In this printer, for example, in order to cause micro vibration of a meniscus (a free surface of ink to be exposed from the nozzles), a pulse for micro vibration (potential change pattern) is applied to a piezoelectric element. If the pulse for micro vibration is applied, weak pressure vibration is applied to ink in a pressure chamber to such an extent that ink is not ejected.

JP-A-2000-117993 is an example of the related art.

With respect to the pressure vibration, amplitude or attenuation time is an important factor. For example, if the amplitude is extremely large, ink droplets may be ejected with irregular timing. If the amplitude is extremely small, thickening is insufficiently suppressed. In addition, if the attenuation time is extremely long, the amount of ink droplets to be ejected from the nozzles may be influenced. If the attenuation time is extremely short, ink may be thickened after attenuation.

For this reason, it is necessary to optimize the amplitude or attenuation time of the pressure vibration to be applied to ink.

SUMMARY

An advantage of some aspects of the invention is that it optimizes a signal for micro vibration.

According to an aspect of the invention, a liquid ejecting apparatus includes liquid chambers in which a liquid is filled, nozzles communicating with the liquid chambers, a signal generator generating a signal of potential change, and elements operating in accordance with the potential of the signal to be applied to cause a change in pressure of the liquid filled in the liquid chambers. The signal generator generates a signal for micro vibration which causes micro vibration of a free surface of the liquid to be exposed from the nozzles to such an extent that the liquid is not ejected. The signal for micro vibration has a first potential change portion at which a potential changes from a first potential to a medium potential defined between the first potential and a second potential, a constant potential portion which is generated after the first potential change portion and at which the potential is maintained constant at the medium potential, and a second potential change portion which is generated after the constant potential portion and at which the potential changes from the medium potential to the second potential.

Other features of the invention will be apparent from the specification and the accompanying drawings.

BRIEF DESCRIPTION OF THE DRAWINGS

The invention will be described with reference to the accompanying drawings, wherein like numbers reference like elements.

FIGS. 5A and 5B are diagrams illustrating dot forming data. Specifically, FIG. 5A is a diagram illustrating the relationship between the size of a dot to be formed and dot forming data, and FIG. 5B is a diagram illustrating the relationship between dot forming data and a pulse to be applied.

FIG. 7A is a diagram showing the state of a meniscus before the pulse for micro vibration is applied, FIG. 7B is a diagram showing an example of a state when a meniscus is pulled in toward a pressure chamber by application of the pulse for micro vibration, and FIG. 7C is a diagram showing an example of a state where a meniscus is pushed out toward a side opposite a pressure chamber by application of the pulse for micro vibration.

FIG. 8A shows pressure vibration to be applied to ink in a pressure chamber due to a first charging portion and pressure vibration to be applied to ink in a pressure chamber due to a second charging portion, and FIG. 8B shows a composite waveform of two kinds of pressure vibration shown in FIG. 8A.

FIG. 12A shows a pulse for micro vibration in which a potential change pattern of a charging portion is linear, and FIG. 12B shows a pulse for micro vibration in which a potential change pattern of a charging portion is curved.

DESCRIPTION OF EXEMPLARY EMBODIMENTS

Figure 1:
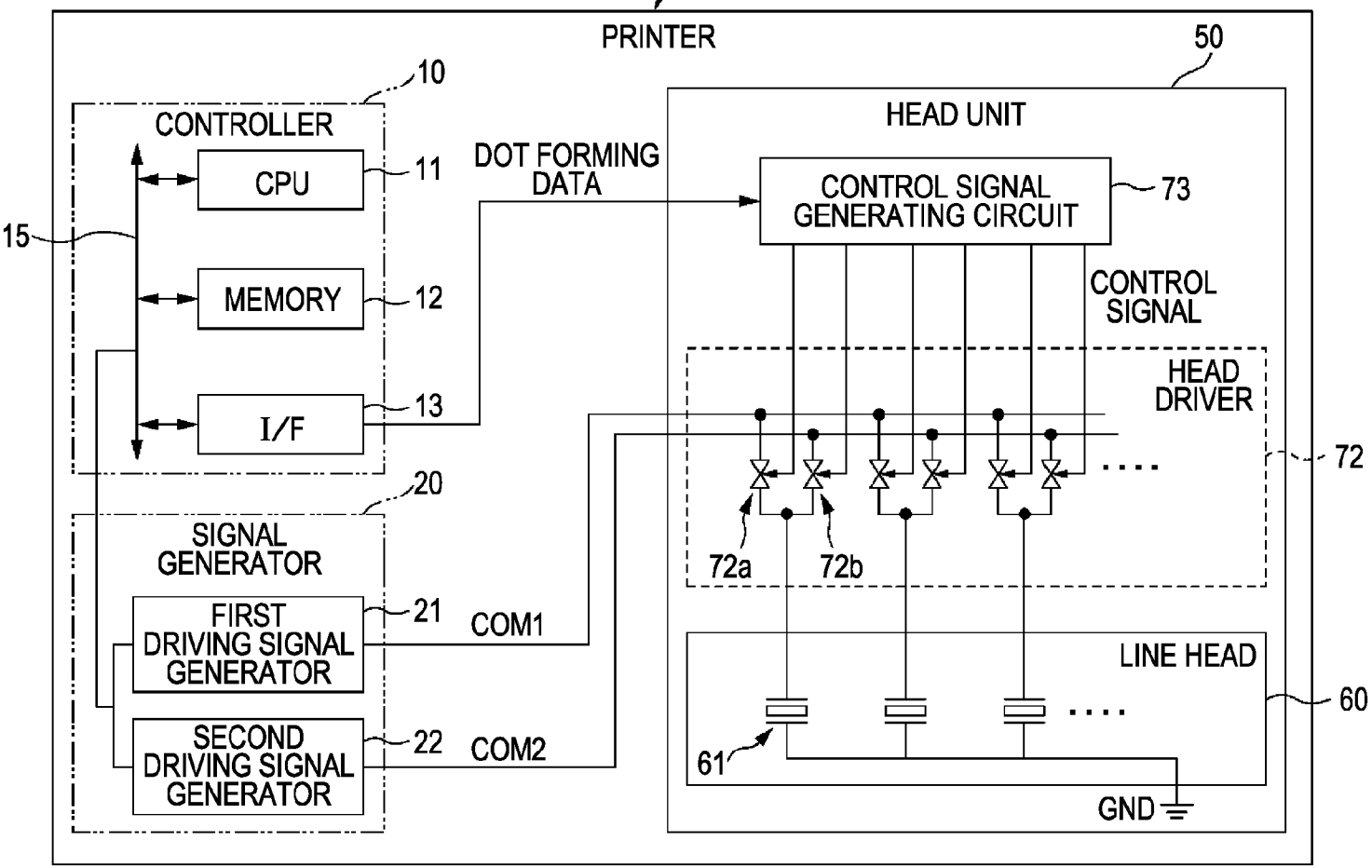
FIG. 1 is a diagram schematically showing the configuration of an ink jet type printer according to a first embodiment of the invention.

At least the following will be apparent from the specification and the accompanying drawings.

A liquid ejecting apparatus includes liquid chambers in which a liquid is filled, nozzles communicating with the liquid chambers, a signal generator generating a signal of potential change, and elements operating in accordance with the potential of the signal to be applied to cause a change in pressure of the liquid filled in the liquid chambers. The signal generator generates a signal for micro vibration which causes micro vibration of a free surface of the liquid to be exposed from the nozzles to such an extent that the liquid is not ejected. The signal for micro vibration has a first potential change portion at which a potential changes from a first potential to a medium potential defined between the first potential and a second potential, a constant potential portion which is generated after the first potential change portion and at which the potential is maintained constant at the medium potential, and a second potential change portion which is generated after the constant potential portion and at which the potential changes from the medium potential to the second potential.

With this liquid ejecting apparatus, an interval between the first potential change portion and the second potential change portion, and the medium potential can be set. Therefore, the amplitude or attenuation time of pressure vibration to be applied to the liquid filled in the liquid chambers can be adjusted. As a result, the amplitude or attenuation time of pressure vibration to be applied to the liquid can be optimized.

A generation start timing of the second potential change portion may be defined within a range represented by Expression (1) starting with a generation start timing of the first potential change portion.

$$nTc+0.5Tc\pm0.25Tc \quad (1)$$

Here, n is an integer of 0 or more, and Tc is a cycle intrinsic to the pressure vibration to be applied to the liquid.

With this configuration, when the second potential change portion starts to be applied, the pressure vibration applied to the liquid due to the first potential change portion can be prevented from being extremely excited.

A difference between the medium potential and the second potential may be larger than a difference between the medium potential and the first potential. With this configuration, the attenuation time of pressure vibration can be appropriately adjusted.

A generation start timing of the second potential change portion may be defined within a range represented by Expression (2) starting with a generation start timing of the first potential change portion.

$$mTc\pm0.25Tc \quad (2)$$

Here, m is an integer of 0 or more, and Tc is a cycle intrinsic to the pressure vibration to be applied to the liquid.

With this configuration, when the second potential change portion starts to be applied, even if the pressure vibration applied to the liquid due to the first potential change portion is attenuated, the pressure vibration can be efficiently excited.

A difference between the medium potential and the second potential may be smaller than a difference between the medium potential and the first potential. With this configuration, the amplitude of the pressure vibration applied to the liquid due to the first potential change portion and the second potential change portion can be optimized.

The liquid ejecting apparatus may further include a pulse generator for defining a generation timing of a liquid ejection signal so as to eject the liquid from the nozzles. The signal may include a first signal having the signal for micro vibration, and a second signal having no signal for micro vibration and having the liquid ejection signal. The pulse may be generated within a generation period of the constant potential portion in the signal for micro vibration.

With this configuration, while the signal for micro vibration is being applied, an influence (noise) of a pulse due to switching of the second signal can be substantially eliminated.

Another liquid ejecting apparatus includes liquid chambers in which a liquid is filled, nozzles communicating with the liquid chambers, a signal generator generating a signal of potential change, and elements operating in accordance with the potential of the signal to be applied to cause a change in pressure of the liquid filled in the liquid chambers. The signal generator generates a signal for micro vibration which causes micro vibration of a free surface of the liquid to be exposed from the nozzles to such an extent that the liquid is not ejected. The signal for micro vibration has a first potential change portion at which a potential changes from a first potential to a medium potential defined between the first potential and a second potential, and a second potential change portion which is generated after the first potential change portion and at which the potential changes from the medium potential to the second potential. The potential change amount per unit time of the second potential change portion is different from that of the first potential change portion.

With this liquid ejecting apparatus, the pressure vibration applied to the liquid due to the first potential change portion can be adjusted by a change in pressure due to the second potential change portion. Therefore, the amplitude or attenuation time of the pressure vibration can be optimized.

There is provided a method of setting a signal for micro vibration, which is applied to elements causing a change in pressure of a liquid in liquid chambers to cause micro vibration of a free surface of the liquid to be exposed from nozzles communicating with the liquid chambers to such an extent that the liquid is not ejected. The method includes setting potential information required for changing a potential from a first potential to a medium potential defined between the first potential and a second potential, setting potential information required for, after the potential has changed from the first potential to the medium potential, maintaining the potential constant at the medium potential, and setting potential information required for, after the potential has been maintained at the medium potential, changing the potential from the medium potential to the second potential.

With this method of setting a signal for micro vibration, an interval between the first potential change portion and the second potential change portion, and the medium potential can be set to have a desired magnitude. With this configuration, the amplitude or attenuation time of pressure vibration to be applied to the liquid filled in the liquid chambers can be adjusted. As a result, the amplitude or attenuation time of pressure vibration to be applied to the liquid can be optimized.

Embodiments of the invention will now be described with reference to the drawings.

First Embodiment

Figure 2:
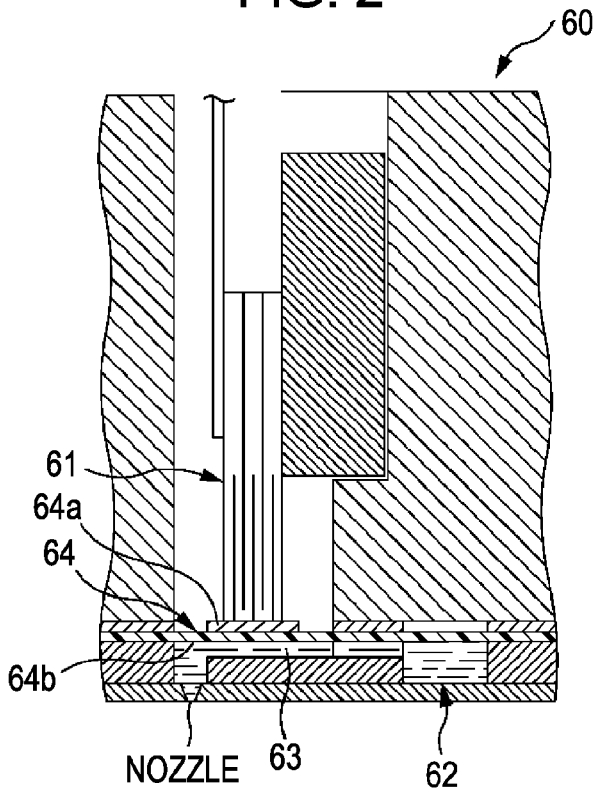
FIG. 2 is a partially enlarged sectional view specifically showing the internal configuration of a line head in FIG. 1.
Figure 3:
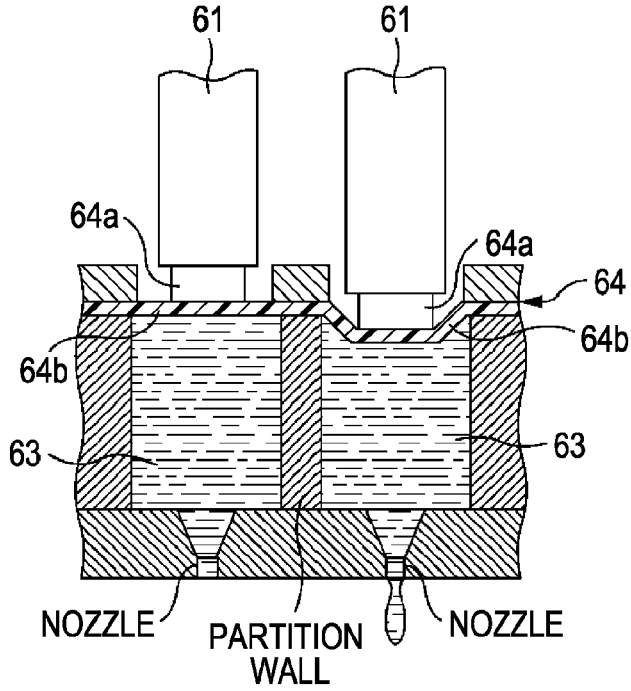
FIG. 3 is a sectional view schematically showing an example where ink droplets are ejected from nozzles in the line head of FIG. 2.
Figure 4:
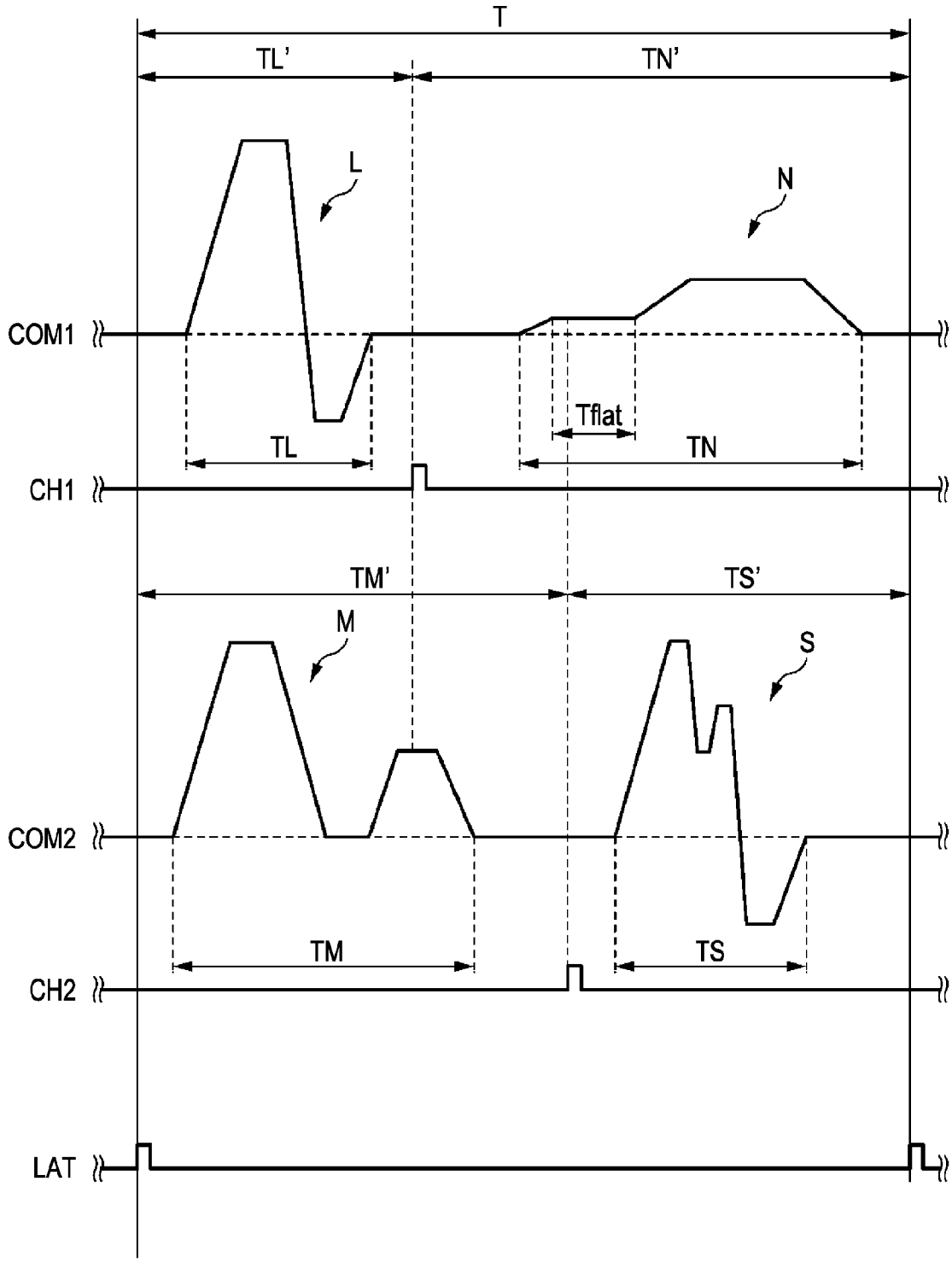
FIG. 4 is a diagram illustrating a driving signal which is generated by a signal generator in FIG. 1.

FIG. 1 is a diagram schematically showing the configuration of an ink jet type printer according to a first embodiment of the invention. FIG. 2 is a partially enlarged sectional view specifically showing the internal configuration of a line head in FIG. 1. FIG. 3 is a sectional view schematically showing an example where ink droplets are ejected from nozzles in the line head of FIG. 2. FIG. 4 is a diagram illustrating a driving signal which is generated by a signal generator in FIG. 1.

Printer

A printer 1 shown in FIG. 1 has a controller 10, a signal generator 20, and a head unit 50. The printer 1 prints an image on a sheet, which is an example of a printing medium, while transporting the sheet in a predetermined direction. During printing, in the printer 1, ink is ejected from nozzles provided in the head unit 50 in the shape of droplets. Ink is a kind of liquid. Therefore, the printer 1 is a kind of liquid ejecting apparatus. The printer 1 defines the size of a dot to be formed on the sheet as one of three kinds (S, M, and L) during printing, and adjusts the amount of an ink droplet to be ejected (for example, volume) in accordance with the defined dot size. In this way, the amount of the ink droplet is adjusted, thereby increasing image quality of a printed matter.

Head Unit 50

As shown in FIG. 1, the head unit 50 has a line head 60, a head driver 72, and a control signal generating circuit 73.

Line Head 60

As shown in FIGS. 2 and 3, the line head 60 includes a plurality of piezoelectric elements 61 and an ink flow channel 62. The ink flow channel 62 has an upstream portion extending to a common ink chamber 62*a* and individual portions from the common ink chamber 62*a* to the nozzles (holes). The individual portions are provided to correspond to the number of piezoelectric elements 61. When the printer 1 is used, the ink flow channel 62 is filled with ink. Pressure chambers 63 are provided in the ink flow channel 62 (that is, in the individual portions). The pressure chambers 63 correspond to liquid chambers in which a liquid is filled, and are partially partitioned by vibrating plates 64.

If driving signals COM1 and COM2 are applied, the piezoelectric elements 61 are charged or discharged by a change in potential of each driving signal. The piezoelectric elements 61 are deformed when being charged or discharged. In this embodiment, each piezoelectric element 61 contracts in a longitudinal direction when being charged, and expands in the longitudinal direction when being discharged. As the piezoelectric element 61 is deformed, the vibrating plate 64 is deformed, and the volume of the pressure chamber 63 is changed. Accordingly, the pressure of ink in the pressure chamber 63 is changed. For this reason, the piezoelectric element 61 is an example of an element operating in accordance with the potential of a signal to be applied, to thereby cause a change in pressure of the liquid filled in the corresponding liquid chamber. The line head 60 is provided with nozzles corresponding to the number of piezoelectric elements 61. The nozzles eject ink droplets and communicate with the pressure chambers 63.

The pressure chambers 63 are arranged in an arrangement direction of the nozzles. Two adjacent pressure chambers 63 and 63 are provided with a thin partition wall interposed therebetween. Between the pressure chamber 63 and the piezoelectric element 61, the vibrating plate 64 is provided. The vibrating plate 64 functions as a movable portion (also called a diaphragm) in the pressure chamber 63. That is, the vibrating plate 64 has a thick portion 64*a* and a thin portion 64*b*. The thick portion 64*a* is attached to a tip surface of the piezoelectric element 61, and the thin portion 64*b* is formed of an elastic material having high elasticity, such as synthetic resin.

If the piezoelectric element 61 is deformed, that is, if the piezoelectric element 61 expands or contracts in the longitudinal direction, the thin portion 64*b* also expands or contracts. Accordingly, the thick portion 64*a* is pressed toward the pressure chamber 63 or is pulled toward a side opposite the pressure chamber 63. If the thick portion 64*a* is pressed toward the pressure chamber 63, the volume of the pressure chamber 63 decreases, and the pressure of ink in the pressure chamber 63 increases. To the contrary, if the thick portion 64*a* is pulled toward the side opposite the pressure chamber 63, the volume of the pressure chamber 63 increases, and the pressure of ink in the pressure chamber 63 decreases. Therefore, by control of the pressure of ink in the pressure chamber 63, ink can be ejected from the nozzle, and micro vibration of a meniscus can be generated (described below).

Head Driver 72

The head driver 72 has a plurality of switches. In the printer 1, each pair of switches has two switches 72*a* and 72*b*. Pairs of switches each having the switches 72*a* and 72*b* are provided to correspond to the number of piezoelectric elements 61. The switches constituting each pair of switches are provided to correspond to the number of driving signals. If the switches 72*a* and 72*b* are put in a conduction state, a corresponding driving signal is applied to the piezoelectric element 61.

Control Signal Generating Circuit 73

The control signal generating circuit 73 is, for example, a logic circuit which generates a control signal in accordance with dot forming data and timing signals (described below) and inputs the generated control signal to the head driver 72. The control signal is a signal for switching the switches 72*a* and 72*b* between a conduction state and a non-conduction state. With the control signal, the operation of the switch 72*a* or the switch 72*b* is controlled.

Signal Generator 20

As shown in FIG. 1, the signal generator 20 has a first driving signal generator 21 generating a first driving signal COM1 and a second driving signal generator 22 generating a second driving signal COM2. The driving signals COM1 and COM2 are repeatedly generated for each repetition cycle T shown in FIG. 4.

Next, the driving signals to be generated by the signal generator 20 will be described.

As shown in FIG. 4, the driving signal COM1 includes a large dot pulse L and a pulse N for micro vibration. The large dot pulse L is generated during a generation period TL. The pulse N for micro vibration is generated during a generation period TN. In addition, the driving signal COM2 includes a medium dot pulse M and a small dot pulse S. The medium dot pulse M is generated during a generation period TM. The small dot pulse S is generated during a generation period TS.

The repetition cycle T of the driving signal COM1 is divided into a period TL' including the generation period TL of the large dot pulse L and a period TN' including the generation period TN of the pulse N for micro vibration by pulses of a change signal CH1. The repetition cycle T of the driving signal COM2 is divided into a period TM' including the generation period TM of the medium dot pulse M and a period TS' including the generation period TS of the small dot pulse S by pulses of a change signal CH2. The change signals CH1 and CH2 are examples of timing signals described below.

Each of the large dot pulse L, the medium dot pulse M, and the small dot pulse S is applied to the piezoelectric element 61 when a dot having a corresponding sizes (S, M, L) is formed. In other words, each of the large dot pulse L, the medium dot pulse M, and the small dot pulse S is used to eject an ink droplet of an amount suitable for the corresponding dot size. The pulses are portions of a liquid ejection signal. That is, the large dot pulse L is a portion of a liquid ejection signal for a large dot which is generated during the generation period TL'. The medium dot pulse M is a portion of a liquid ejection signal for a medium dot which is generated during the generation period TM'. Similarly, the small dot pulse S is a portion of a liquid ejection signal for a small dot which is generated during the generation period TS'. Hereinafter, the three pulses are also collectively referred to as ejection pulses.

The pulse N for micro vibration is used to cause micro vibration of a meniscus when ink is not ejected. If the pulse N for micro vibration is applied to the piezoelectric element 61, ink in the pressure chamber 63 undergoes a change in pressure to such an extent that ink is not ejected from the nozzle. The change in pressure causes micro vibration of the meniscus. Therefore, the pulse N for micro vibration is a non-ejection pulse to suppress ink ejection from the nozzles, and is a portion of the signal for micro vibration to cause micro vibration of the meniscus. That is, the pulse N for micro vibration is a portion of the signal for micro vibration which is generated during the generation period TN'. The pulse N for micro vibration and a micro vibration operation using the pulse N for micro vibration will be described below in detail.

As described above, the driving signal COM1 includes the liquid ejection signal for a large dot and the signal for micro vibration, and the driving signal COM2 includes the liquid ejection signal for a medium dot and the liquid ejection signal for a small dot. From this, it can be considered that the driving signal COM1 is an example of a first signal having a signal for micro vibration, and the driving signal COM2 is an example of a second signal having no signal for micro vibration and having a liquid ejection signal.

Controller 10

As shown in FIG. 1, the controller 10 has a CPU 11 controlling the individual sections of the printer 1, a memory 12 serving as a storage medium, an interface (I/F) 13 disposed in the printer 1, and an internal bus 15 connecting the CPU 11, the memory 12, and the I/F 13.

The memory 12 stores programs and various kinds of data. The programs include a program (firmware) for control of the individual sections of the printer 1. Data includes image data to be printed and waveform generation information. Two kinds of the waveform generation information are present. The waveform generation information is digital data in which potential information of each of the driving signals COM1 and COM2 is arranged in time series.

The CPU 11 reads out and executes a program stored in the memory 12 to control sheet transport, generation of the driving signals by the signal generator 20, and ejection of ink droplets by the head unit 50.

In order to control ejection of ink droplets, the CPU 11 generates dot forming data and timing signals, and inputs the generated dot forming data and timing signals to the control signal generating circuit 73. Dot forming data is generated from image data to be printed. The timing signals collectively refer to a latch signal LAT and the change signals CH1 and CH2, and include pulses defining timing for control such that a dot is formed in each unit area of a predetermined size or no dot is formed. The pulses of the latch signal LAT are generated in the same cycle as the repetition cycle T. The pulses of the change signal CH1 are generated during the repetition cycle T. The pulses of the change signal CH2 are also generated during the repetition cycle T. In this example, the pulses of the change signal CH2 are generated with timing different from those of the change signal CH1 (see FIG. 4). The CPU 11, that is, the controller 10 is a kind of pulse generator that generates a pulse for defining a generation timing of the liquid ejection signal to be used to eject the liquid from the nozzle.

In order to control generation of the driving signals by the signal generator 20, the CPU 11 transmits the waveform generation information read from the memory 12 to the signal generator 20 in time series.

Operation of Printer 1

In the printer 1 having the above configuration, during printing, ink droplets are ejected from the nozzles while a sheet is transported. The ink droplets are landed on the sheet to form dots, and thus an image is formed.

Operation of Printer 1 when Ink is Ejected

The operation of the printer 1 during ink ejection (hereinafter, also referred to as an ejection operation) will be described. For the ejection operation, the CPU 11 reads out and executes a computer program (firmware) stored in the memory 12. To this end, firmware has program codes for control related to the ejection operation.

First, the CPU 11 analyzes image data to be printed, defines the size (S, M, or L) of a dot to be formed on the sheet, and generates dot forming data in accordance with the defined dot size. In the printer 1, as shown in FIG. 5A, dot forming data has two bits per dot. Specifically, when a large dot (L) is formed, the bit values of the dot forming data are set to "11". When a medium dot (M) is formed, the bit values are set to "10". When a small dot (S) is formed, the bit values are set to "01". In addition, when no dot is formed (ink is not ejected), the bit values of dot forming data are set to "00" (described below). Therefore, dot forming data includes information regarding whether or not to form a dot and information for specifying the size of a dot to be formed. The CPU 11 inputs dot forming data to the control signal generating circuit 73.

In the printer 1, each time the sheet is transported by the amount corresponding to one column (1 dot line) of a unit area arranged in a sheet width direction, the signal level of the latch signal LAT changes. If the signal level changes, the signal generator 20 starts to generate the driving signals (the driving signals COM1 and COM2). The transport speed of the sheet during printing is uniform. For this reason, the driving signals are repeatedly generated for each repetition cycle T. The generated driving signals COM1 and COM2 are input to the head driver 72.

The control signal generating circuit 73 generates the control signal for each piezoelectric element 61 on the basis of dot forming data input from the controller 10. The generated control signal is output to a pair of switches (the switches 72*a* and 72*b*) corresponding to the piezoelectric element 61.

The control signal assigns a pulse to be applied to each piezoelectric element 61 (hereinafter, also referred to as a pulse to be applied). FIG. 5B shows the relationship between dot forming data and the pulse to be applied. Specifically, when the bit values of dot forming data are "11", the large dot pulse L becomes a pulse to be applied. When the bit values are "10", the medium dot pulse M becomes a pulse to be applied. When the bit values are "01", the small dot pulse S becomes a pulse to be applied.

A pair of switches operate in accordance with the control signal input from the control signal generating circuit 73. As a result, the pulse to be applied is applied to the piezoelectric element 61. The description is provided for the ejection operation, and thus the pulse to be applied is one of the ejection pulses. That is, an ejection pulse is applied to the piezoelectric element 61. When this happens, an ink droplet in a corresponding amount is ejected from the nozzle, and a dot of a corresponding size (S, M, or L) is formed on the sheet.

Such an ejection operation is performed each time the signal level of the latch signal LAT changes. Thus, an image is formed on the sheet. Such control is performed for each pair of switches.

Operation of Printer 1 when No Ink is Ejected

Next, a case in which an ejection operation is not performed (no dot is formed) will be described. Control when no dot is formed is performed in parallel to the control during the ejection operation. In order to perform parallel control, the bit values of dot forming data can be set to "00" (see FIG. 5A).

When no dot is formed, the controller 10 generates dot forming data having the bit values "00", and inputs the generated dot forming data to the control signal generating circuit 73. When the bit values of dot forming data are "00", the control signal generating circuit 73 assigns the pulse N for micro vibration as a pulse to be applied (see FIG. 5B). Thus, the pulse N for micro vibration is applied to the piezoelectric element 61.

In this case, the piezoelectric element 61 operates in accordance with a potential change pattern of the pulse N for micro vibration. As a result, the pressure of ink in the pressure chamber 63 changes. No ink is ejected from the corresponding nozzle. As will be apparent from FIG. 4, this is because the change range of the potential of the pulse N for micro vibration is smaller than the change range of the potential of the ejection pulse, and thus a change in pressure of ink is also small. The change in pressure of ink causes micro vibration of the meniscus. The micro vibration of the meniscus ensures stirring of ink near the nozzle, and thus ink can be prevented from being thickened.

Pulse N for Micro Vibration

In this embodiment, the pulse N for micro vibration is designed such that the amplitude or duration of micro vibration of the meniscus is optimized. Specifically, the pulse N for micro vibration is designed so as to cause micro vibration of the meniscus at amplitude sufficient to prevent ink droplets from being ejected with irregular timing and prevent ink from being thickened. In addition, the pulse N for micro vibration is designed so as to cause micro vibration of the meniscus with duration sufficient to suppress an adverse effect on the amount of an ink droplet to be ejected from the nozzle and to prevent ink from being noticeably thickened after micro vibration ends.

Figure 6:
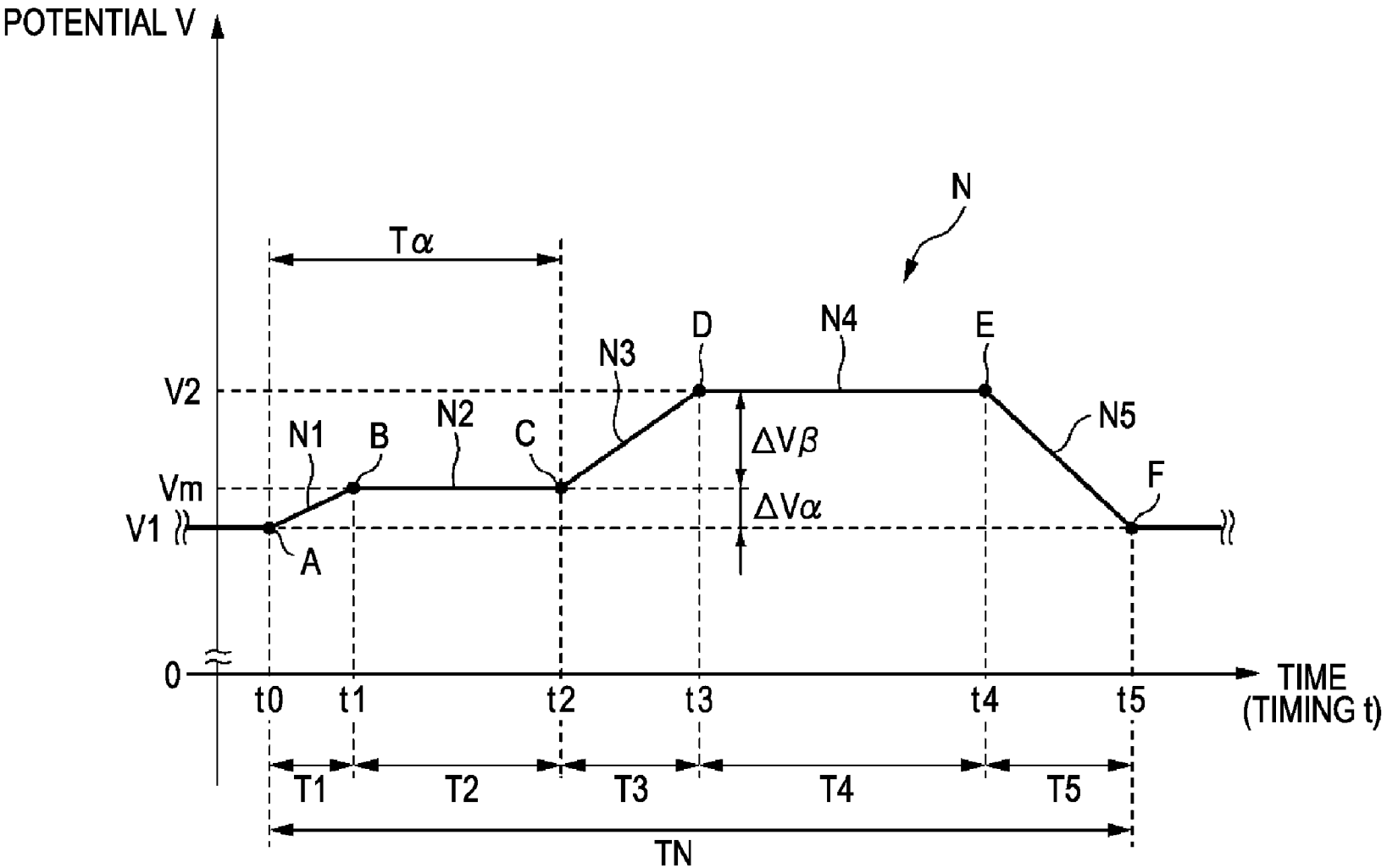
FIG. 6 is an enlarged view of a pulse for micro vibration shown in FIG. 4.

First, the pulse N for micro vibration designed as described above will be described in detail. FIG. 6 is an enlarged view of the pulse N for micro vibration shown in FIG. 4 to illustrate a potential change pattern of the pulse N for micro vibration.

As shown in FIG. 6, the pulse N for micro vibration has a first charging portion N1, a first constant potential portion N2, a second charging portion N3, a second constant potential portion N4, and a discharging portion N5. The portions N1 to N5 are generated during timing t0 to t5 (the generation period TN). The portions N1 and N2 are connected to each other and are generated during the timing t0 to t2 (period Tα). The portions N2 and N3 are connected to each other. The portions N3 and N4 are connected to each other, and the portions N4 and N5 are connected to each other. That is, the portions N1 to N5 form a series of potential change pattern.

Next, the portions will be described.

The first charging portion N1 corresponds to a line segment AB during a generation period T1. The generation period T1 is a period from the timing t0 to the timing t1. The generation period T1 is preferably set to be equal to or longer than an intrinsic vibration cycle of the piezoelectric element 61. In the first charging portion N1, a potential V rises from a potential V1 to a micro vibration medium potential Vm. The potential V is a potential to be input to one terminal of the piezoelectric element 61 (see FIG. 1). In the first charging portion N1, the potential of one terminal of the piezoelectric element 61 rises from the potential V1 to the micro vibration medium potential Vm, thereby charging the piezoelectric element 61.

The potential V1 is a reference potential preset in the printer 1, and is an example of a first potential. A potential V2 is a high potential (a potential difference from the potential V1) set to such an extent that ink is not ejected even if the potential is applied to the piezoelectric element 61, and is an example of a second potential. The micro vibration medium potential Vm is a predefined potential (described below) between the potential V1 and the potential V2 higher than the potential V1, and is an example of a medium potential defined between the first potential and the second potential. In this embodiment, the potential V2 is higher than the potential V1, for example, by 5 V, and the micro vibration medium potential Vm is higher than the potential V1, for example, by 1 V. Thus, the first charging portion N1 is an example of a first potential change portion at which a potential changes from the first potential to the medium potential defined between the first potential and the second potential.

With respect to the first charging portion N1, the absolute value (that is, |Vm−V1|) of a difference between the potential V1 and the micro vibration medium potential Vm is a potential difference ΔVα. That is, the potential difference ΔVα is an example of a difference between the medium potential and the first potential. In this embodiment, a potential change pattern of the first charging portion N1 is linear, and the slope thereof is constant to be a potential change amount per unit time (ΔVα/T1).

The first constant potential portion N2 corresponds to a line segment BC during the timing t1 to t2 (generation period T2). In the first constant potential portion N2, the potential V is constant at the micro vibration medium potential Vm. Thus, the first constant potential portion N2 is an example of a constant potential portion which is generated after the first potential change portion and at which the potential is constant at the medium potential. The first constant potential portion N2 is used to maintain the piezoelectric element 61 in a predetermined deformation state.

The second charging portion N3 corresponds to a line segment CD during a generation period T3. The generation period T3 is a period from the timing t2 to the timing t3. The generation period T3 is preferably set to be equal to or longer than the intrinsic vibration cycle of the piezoelectric element 61. In the second charging portion N3, the potential V rises from the micro vibration medium potential Vm to the potential V2. Thus, the second charging portion N3 is an example of a second potential change portion which is generated after the constant potential portion and at which the potential changes from the medium potential to the second potential. In the second charging portion N3, the potential V rises from the micro vibration medium potential Vm to the potential V2, thereby charging the piezoelectric element 61. The absolute value (that is, |V2−Vm|) of a difference between the micro vibration medium potential Vm and the potential V2 is a potential difference ΔVβ shown in FIG. 6. That is, the potential difference ΔVβ is an example of a difference between the medium potential and the second potential. In this embodiment, a potential change pattern of the second charging portion N3 is linear, and the slope thereof is constant to be a potential change amount per unit time (ΔVβ/T3).

The second constant potential portion N4 corresponds to a line segment DE during the timing t3 to t4 (generation period T4). In the second constant potential portion N4, the potential V is constant at the potential V2. The second constant potential portion N4 is used to maintain the piezoelectric element 61 in a predetermined deformation state.

The discharging portion N5 corresponds to a line segment EF during a generation period T5. The generation period T5 is a period from the timing t4 to the timing t5. The generation period T5 is preferably set to be equal to or longer than the intrinsic vibration cycle of the piezoelectric element 61. In the discharging portion N5, the potential V falls from the potential V2 to the potential V1. In the discharging portion N5, the potential V falls from the potential V2 to the potential V1, thereby discharging the piezoelectric element 61. In this embodiment, a potential change pattern of the discharging portion N5 is linear, and the slope thereof is constant to be a value defined by a potential change amount per unit time (|V1−V2|/T5), that is, (V1−V2)/T5.

As described above in detail, the pulse N for micro vibration of this embodiment has one constant potential portion (the portion N2) between the generation periods of the two charging portions (the portions N1 and N3). If the pulse N for micro vibration is applied to the piezoelectric element 61, micro vibration of the meniscus can be generated. The micro vibration continues with sufficient duration (for example, the generation period TN) in a state where the amplitude is maintained so as to prevent ink from being thickened. This will be described below in detail.

State of Ink Before and when Pulse N for Micro Vibration is Applied

Figure 7A:
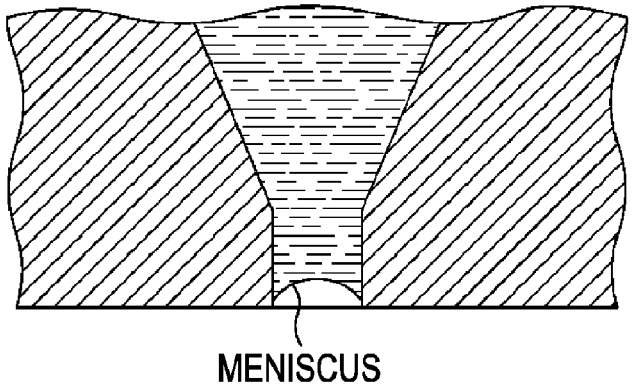
FIGS. 7A to 7C are diagrams showing the state of a meniscus before and when the pulse for micro vibration shown in FIG. 6 is applied to a piezoelectric element. Specifically.
Figure 7B:
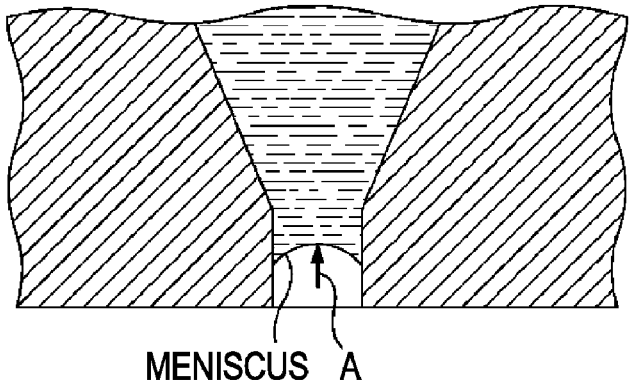
Figure 7C:
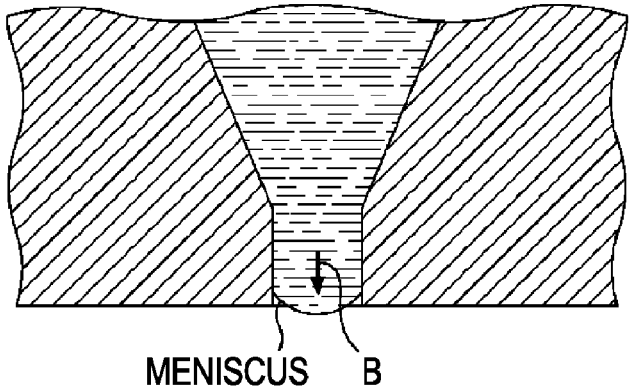

Next, the state of ink before and when the pulse N for micro vibration is applied to the piezoelectric element 61 will be described with reference to FIGS. 7A to 7C.

First, before the pulse N for micro vibration is applied to the piezoelectric element 61, the potential V is constant at the potential V1. The piezoelectric element 61 is maintained in a deformation state according to the potential V1. For this reason, the pressure chamber 63 is kept to a corresponding volume, and no change in pressure occurs in ink filled in the pressure chamber 63. Therefore, the meniscus is in a stationary state. The state of the meniscus at that time is shown in FIG. 7A.

Next, if the first charging portion N1 starts to be applied to the piezoelectric element 61, the piezoelectric element 61 is charged and contracts in an up-down direction (the longitudinal direction of the piezoelectric element 61) shown in FIG. 3. The contraction causes movement of the vibrating plate 64 in an upper direction in FIG. 3, that is, in a direction away from the nozzle. As a result, the volume of the pressure chamber 63 increases. If the volume of the pressure chamber 63 increases, the pressure of ink decreases. For this reason, ink flows into the pressure chamber 63. In this case, ink flows from the common ink chamber 62*a*. If the pressure of ink in the pressure chamber 63 decreases, the meniscus is pulled in toward the pressure chamber 63, that is, in a direction of an arrow A shown in FIG. 7B.

The pressure chamber 63, the nozzle, and an ink supply channel (a portion communicating the common ink chamber 62*a* with the pressure chamber 63) are formed as a single body and function as an acoustic tube. This is because the pressure chamber 63 corresponds to a flow channel portion having a large sectional area rather than the nozzle or the ink supply channel. Since the pressure chamber 63, the nozzle, and the ink supply channel are formed as a single body and function as an acoustic tube, when the first charging portion N1 is applied to the piezoelectric element 61, pressure vibration of an intrinsic cycle (Helmholtz's resonance cycle) is applied to ink in the pressure chamber 63. If pressure vibration is applied to ink in the pressure chamber 63, the meniscus vibrates in the nozzle.

Next, the first constant potential portion N2 is applied to the piezoelectric element 61, but the first constant potential portion N2 causes no change in potential (potential V) on one terminal of the piezoelectric element 61. For this reason, the piezoelectric element 61 is maintained in a contraction state corresponding to the micro vibration medium potential Vm over the generation period T2 of the first constant potential portion N2. Thus, the volume of the pressure chamber 63 is maintained constant. In this case, the meniscus moves in the nozzle by pressure vibration due to the first charging portion N1.

Next, the second charging portion N3 and the second constant potential portion N4 are sequentially applied to the piezoelectric element 61. The states of ink at that time are the same as those when the first charging portion N1 and the first constant potential portion N2 are applied to the piezoelectric element 61. Therefore, while the second charging portion N3 is being applied, the meniscus is pulled in toward the pressure chamber 63. In addition, while the second constant potential portion N4 is being applied, the meniscus moves in the nozzle.

Finally, the discharging portion N5 is applied to the piezoelectric element 61. When this happens, the piezoelectric element 61 is discharged, and the piezoelectric element 61 expands in the longitudinal direction. The expansion causes movement of the vibrating plate 64 toward the pressure chamber 63. With the movement of the vibrating plate 64, the meniscus is pushed out in an ejection direction (a direction of an arrow B shown in FIG. 7C). Thereafter, pressure vibration of ink is attenuated, and the meniscus returns to the state shown in FIG. 7A.

As described above, if the pulse N for micro vibration is applied to the piezoelectric element 61, the meniscus vibrates in accordance with pressure vibration applied to ink in the pressure chamber 63. For example, the meniscus repeatedly moves between a state pulled in toward the pressure chamber 63 (a state shown in FIG. 7B) and a state pushed out in the ejection direction (a state shown in FIG. 7C).

Pressure Vibration of Ink

Next, pressure vibration to be applied to ink by the pulse N for micro vibration will be described in detail.

As described above, if the first charging portion N1 or the second charging portion N3 is applied to the piezoelectric element 61, pressure vibration is applied to ink in the pressure chamber 63.

In this embodiment, a generation start timing of the first charging portion N1 is different from a generation start timing of the second charging portion N3. The generation start timing used herein means a timing at which the portion N1 or N3 starts to be applied to the piezoelectric element 61. In the pulse N for micro vibration of the FIG. 6, the timing t0 or t2 corresponds to the generation start timing of the portion N1 or the portion N3. In this way, since the generation start timing of the portion N1 is different from the generation start timing of the portion N3, complex pressure vibration occurs in ink of the pressure chamber 63.

For ease of understanding, pressure vibration to be applied to ink in the pressure chamber 63 due to the first charging portion N1 and pressure vibration to be applied to ink in the pressure chamber 63 due to the second charging portion N3 are considered separately.

Figure 8A:
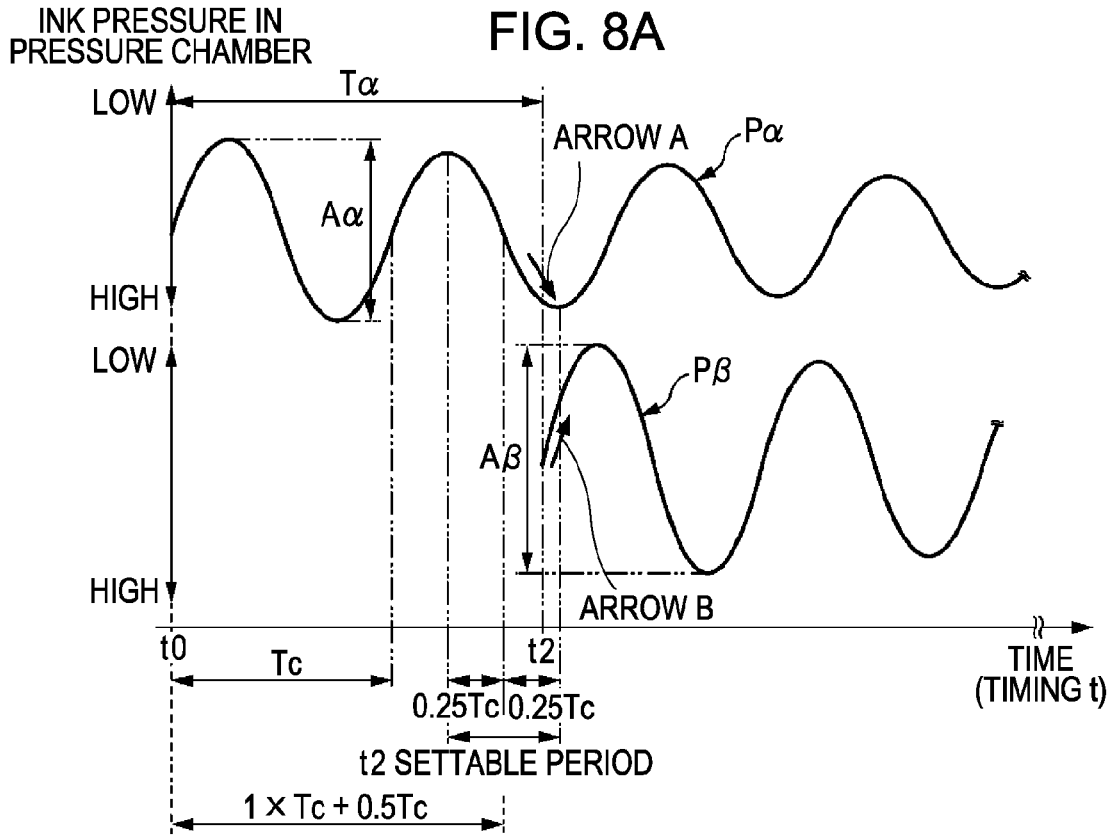
FIGS. 8A and 8B are diagrams illustrating pressure vibration to be applied to ink in a pressure chamber when the pulse for micro vibration shown in FIG. 6 is applied to a piezoelectric element. Specifically.

FIG. 8A shows an example of pressure vibration to be applied to ink in the pressure chamber 63 due to the first charging portion N1. FIG. 8A also shows an example of pressure vibration to be applied to ink in the pressure chamber 63 due to the second charging portion N3. In FIG. 8A, the vertical axis represents an ink pressure in the pressure chamber 61. The ink pressure is low on an upper side, and is high on a lower side. The horizontal axis represents a time. Therefore, an upward-sloping portion of a line representing pressure vibration indicates the state that the ink pressure decreases as time passes. To the contrary, a downward-sloping portion of the line indicates the state that the ink pressure increases as time passes.

A pressure vibration waveform Pα shown in FIG. 8A represents pressure vibration applied to ink due to the first charging portion N1. The cycle (intrinsic vibration cycle Tc) of the pressure vibration waveform Pα is defined by the structure of the pressure chamber 63, the material of the vibrating plate 64, the property of ink, and the like. In this line head 60, the cycle of the pressure vibration waveform Pα is in a range of approximately 5.5 μs to 6.0 μs. The amplitude of the pressure vibration waveform Pα decreases as time passes. For this reason, amplitude Aα in a first cycle becomes maximum amplitude in the pressure vibration waveform Pα.

A pressure vibration waveform Pβ shown in FIG. 8A represents pressure vibration applied to ink in the pressure chamber 63 due to the second charging portion N3. The cycle of the pressure vibration waveform Pβ is the same as the cycle of the pressure vibration waveform Pα. The amplitude of the pressure vibration waveform Pβ is also attenuated as time passes. For this reason, amplitude Aβ in a first cycle becomes maximum amplitude in the pressure vibration waveform Pβ. In this embodiment, the maximum amplitude Aβ of the pressure vibration waveform Pβ is set so as to be larger than the maximum amplitude Aα of the pressure vibration waveform Pα (the details will be described below).

Figure 8B:
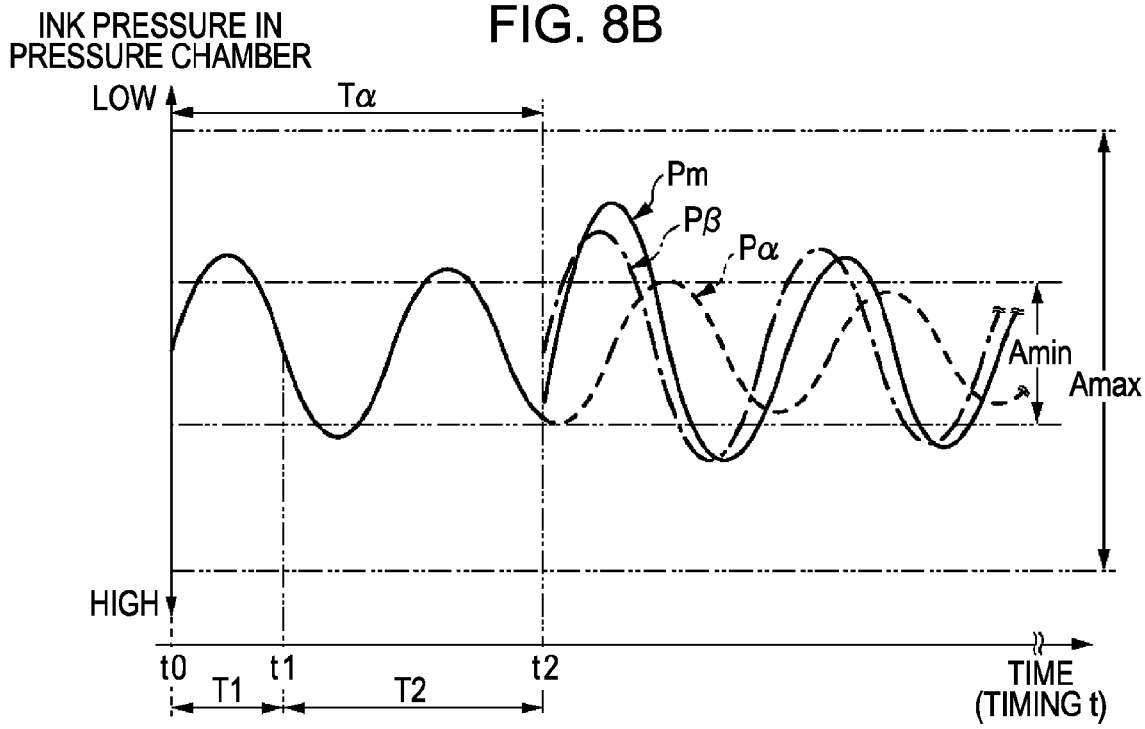

Next, a composite waveform of the two pressure vibration waveforms Pα and Pβ is considered. The composite waveform is shown in FIG. 8B as a composite waveform Pm. In FIG. 8B, the pressure vibration waveforms Pα and Pβ of FIG. 8A are indicated by a broken line and a one-dot-chain line, respectively. Like FIG. 8A, the vertical axis and horizontal axis of the FIG. 8B represents an ink pressure and a time, respectively.

From a period Tα from timing t0 to timing t2, the second charging portion N3 is not applied to the piezoelectric element 61. For this reason, during the period Tα, the composite waveform Pm is identical to the above-described pressure vibration waveform Pα, and the amplitude thereof decreases as time passes. The second charging portion N3 is applied to the piezoelectric element 61 at the timing t2. If the second charging portion N3 is applied, the pressure vibration waveform Pβ is added to the pressure vibration waveform Pα. For this reason, the composite waveform Pm is different from the pressure vibration waveform Pα after the timing t2.

That is, the amplitude of the composite waveform Pm increases immediately after the timing t2, and then decreases as time passes. The reason why the amplitude of the composite waveform Pm increases immediately after the timing t2 is that the pressure vibration waveform Pα starting to be attenuated is excited by the pressure vibration waveform Pβ immediately after the timing t2.

As described above, in this embodiment, the pulse N for micro vibration includes the two charging portions (the portions N1 and N3) having different generation start timing, thereby exciting pressure vibration starting to be attenuated. This pressure vibration affects on the amplitude of micro vibration of the meniscus. That is, if the pressure vibration is excited, the amplitude of pressure vibration (that is, the amplitude of micro vibration of the meniscus) can be increased. Therefore, even though ink is insufficiently prevented from being thickened, an insufficient effect can be restored such that ink can be sufficiently prevented from being thickened. In addition, if the amplitude of pressure vibration increases, the duration of pressure vibration also increases.

In the example shown in FIG. 8B, excitation by the pressure vibration waveform Pβ starts at the timing t2. The timing t2 is defined in a downward-sloping portion in the pressure vibration waveform Pα. In other words, the timing t2 is defined during a period in which the ink pressure increases (described below in detail). For this reason, at this timing, the meniscus is pushed out in the ejection direction. Meanwhile, in the pressure vibration waveform Pβ, an upward-sloping portion is present immediately after the timing t2. That is, the ink pressure decreases as time passes. In other words, immediately after the timing t2, it can be considered that the pressure vibration waveform Pβ is out of phase with the pressure vibration waveform Pα.

As described above, since the pressure vibration waveform Pβ is out of phase with the pressure vibration waveform Pα, at the beginning of excitation immediately after the second charging portion N3 is applied to the piezoelectric element 61, pressure vibration due to the second charging portion N3 is slightly weakened by pressure vibration due to the first charging portion N1. In other words, the pressure vibration waveform Pβ is out of phase with the pressure vibration waveform Pα such that a change in pressure of ink due to the second charging portion N3 is weakened by pressure vibration applied to ink due to the first charging portion N1 when the second charging portion N3 starts to be applied to the piezoelectric element 61. Therefore, ink in the pressure chamber 63 can be prevented from being extremely excited. As a result, the amplitude of the composite waveform Pm can be prevented from being unnecessarily increased.

The amplitude of the composite waveform Pm indirectly represents the displacement of the meniscus. For this reason, the amplitude of micro vibration of the meniscus can be prevented from being extremely increased. That is, ink can be prevented from being ejected with irregular timing. In this embodiment, the maximum amplitude of the composite waveform Pm is defined so as to be within a range of allowable maximum amplitude Amax.

Since the excitation by the pressure vibration waveform Pβ starts at the timing t2, the maximum amplitude of the composite waveform Pm may be defined in accordance with the potential difference ΔVβ of the second charging portion N3. In setting the potential difference ΔVβ, the maximum amplitude (amplitude Aβ) of the pressure vibration waveform Pβ is preferably set so as to be larger than the maximum amplitude (amplitude Aα) of the pressure vibration waveform Pα. From this viewpoint, as shown in FIG. 6, the potential difference ΔVβ is set so as to be larger than the potential difference ΔVα. That is, the micro vibration medium potential Vm (the potential of a point B or C) is set so as to be near the potential V1. If the micro vibration medium potential Vm is set in the above-described manner, immediately after the timing t2, the amplitude (specifically, maximum amplitude) of the composite waveform Pm can be defined as desired. Thus, the attenuation time of the composite waveform Pm can also be adjusted to a desired length. In order to realize a reliable ink thickening suppression effect by pressure vibration due to the first charging portion N1, the potential difference is preferably defined such that the potential difference ΔVα becomes 5% or more of the potential difference (ΔVα+ΔVβ) between the potential V2 and the potential V1, that is, the potential difference ΔVβ is within 95% of the potential difference between the potential V2 and the potential V1.

In this embodiment, the generation start timing (timing t2) of the second charging portion N3 is set starting with the generation start timing (timing t0) of the first charging portion N1. That is, the timing t2 is defined using the intrinsic vibration cycle Tc. This will be described below.

The timing t2 is defined in a section at which the pressure vibration waveform Pα slopes downward, in other words, during a period in which the ink pressure increases. Such a section appears cyclically, and thus a plurality of sections are present. Each section corresponds to a period from one-quarter cycle to three-quarters cycle in each cycle of the intrinsic vibration cycle Tc. For this reason, each section corresponds to a period represented by Expression (3) starting with a start point of a first cycle of the pressure vibration waveform Pα. The start point of the first cycle of the pressure vibration waveform Pα is the timing t0.

$$nTc+0.5Tc\pm0.25Tc \quad (3)$$

For Expression (3), n is an integer of "0" or more.

Therefore, the timing t2 is defined within the period represented by Expression (3) starting with the timing t0. In the example of FIG. 8A, the timing t2 is defined on an assumption that the integer n is "1". In this case, the timing t2 can be defined within the t2 settable period.

It is considered that the integer n has an upper limit value. This is because pressure vibration is attenuated as time passes. In this embodiment, the amplitude of the pressure vibration waveform Pα when being attenuated is defined so as not to be smaller than the range Amin shown in FIG. 8B. The range Amin indicates the boundary of an amplitude range of the pressure vibration in which ink is insufficiently prevented from being thickened. The range Amin is preferably defined on the basis of a degree of attenuation of the pressure vibration waveform Pα.

The generation period T2 in which the first constant potential portion N2 is generated is defined on the basis of the period Tα. That is, a difference between the period Tα and the generation period T1 in which the first charging portion N1 is generated becomes the generation period T2. That is, the relationship T2=Tα−T1 is established. The generation period T2 corresponds to an interval between the first potential change portion and the second potential change portion.

Advantages of First Embodiment

According to the above-described first embodiment, the pulse N for micro vibration has the first constant potential portion N2 which is generated between the generation period of the first charging portion N1 and the generation period of the second charging portion N3. For this reason, an interval between the first charging portion N1 and the second charging portion N3, and the micro vibration medium potential Vm can be set. Therefore, the amplitude of the composite waveform Pm or the attenuation time of the composite waveform Pm can be adjusted. The composite waveform Pm causes micro vibration of the meniscus. As a result, the amplitude or duration of micro vibration of the meniscus can be optimized.

According to this embodiment, the pressure vibration waveform Pβ, which is a component of the composite waveform Pm, is out of phase with the pressure vibration waveform Pα such that the pressure vibration waveform Pβ is weakened by the pressure vibration waveform Pα, which is another component of the composite waveform Pm, immediately after composition. In other words, the pressure vibration waveform Pβ is out of phase with the pressure vibration waveform Pα such that the change in pressure of ink due to the second charging portion N3 is weakened by pressure vibration applied to the piezoelectric element 61 due to the first charging portion N1 when the second charging portion N3 is applied to the piezoelectric element 61 (at the beginning of excitation). Therefore, pressure vibration applied to ink due to the first charging portion N1 can be prevented from being extremely excited immediately after the timing t2. The timing t2 is defined within the t2 settable period on the basis of the intrinsic vibration cycle Tc by Expression (3).

According to this embodiment, the potential difference ΔVβ is larger than the potential difference ΔVα. Therefore, the attenuation time of the composite waveform Pm, that is, the duration of micro vibration of the meniscus can be appropriately adjusted.

Timing t4

In this embodiment, like the timing t2, the timing t4 (the total time of the generation period T3 and the generation period T4) is defined within the range represented by Expression (3). However, the timing t4 is defined starting with the timing t2, not the timing t0. If the timing t4 is defined in the above-described manner, the pressure vibration waveform Pβ is easily in phase with the pressure vibration waveform Pα, and thus vibration of the meniscus can be efficiently suppressed. As a result, when a next ejection pulse (large dot pulse L) is applied to the piezoelectric element 61, there is no case in which vibration of the meniscus caused by application of the pulse N for micro vibration to the piezoelectric element 61 remains (residual vibration). Therefore, there is no influence on the amount of an ink droplet to be ejected from the nozzle. As a result, a variation in the amount of an ink droplet to be ejected can be eliminated, and thus an ink droplet can be stably ejected.

Adjacent Crosstalk

In this embodiment, as the driving signal for driving the piezoelectric element 61, the two driving signals COM1 and COM2 are used. Therefore, a plurality of pulses can be generated at the repetition cycle T. In this way, dot formation for one dot line can be speeded up.

However, when the generation periods of a plurality of pulses at the repetition cycle T overlap each other, a variation in the amount of an ink droplet to be ejected from the nozzle may occur due to the adjacent crosstalk phenomenon. The adjacent crosstalk phenomenon occurs between adjacent pressure chambers 63 and 63, and means the phenomenon that a change in pressure of one pressure chamber 63 propagates through the partition wall and has an affect on the ink pressure of the other pressure chamber 63.

It is assumed that the pulse for micro vibration is generated at the first half of the repetition cycle T, and the small dot pulse is generated at the second half of the repetition cycle T. In this case, if pressure vibration applied to ink by the pulse for micro vibration is extremely large, a change in pressure propagates an adjacent pressure chamber 63, and a variation in the amount of an ink droplet for a small dot to be ejected may occur. From this viewpoint, if the pulse N for micro vibration of this embodiment is used, the amplitude of pressure vibration can be suppressed, and the pressure vibration can be maintained for a long time. Therefore, an influence of adjacent crosstalk on the adjacent pressure chamber 63 can be suppressed. For example, a variation in the amount of an ink droplet for a small dot to be ejected can be suppressed.

Change Signal CH

The CPU 11 generates the change signal CH2 within the generation period (a period Tflat of FIG. 4) of the constant potential portion (specifically, the first constant potential portion N2) of the pulse N for micro vibration in the generation period of the pulse N for micro vibration. In this way, if the change signal CH2 is generated within the generation period of the constant potential portion of the pulse N for micro vibration, while the pulse N for micro vibration is being applied to the piezoelectric element 61, an influence (noise) of a pulse due to switching of the change signal CH2 can be substantially eliminated. The change signal is used when the control signal generating circuit 72 switches the switches 72*a* and 72*b*. During the switching operation of the switches, noise easily occurs in the driving signal.

Similarly, in order to substantially eliminate an influence (noise) of a pulse due to switching of the change signal CH1 on the medium dot pulse M while the medium dot pulse M is being applied to the piezoelectric element 61, the CPU 11 generates the change signal CH1 within the generation period of the constant potential portion of the medium dot pulse M.

Method of Setting Pulse N for Micro Vibration

The potential change pattern of the pulse N for micro vibration is defined in accordance with the waveform generation information stored in the memory 12 in advance. In other words, the potential information (digital data) of the pulse N for micro vibration is set when the waveform generation information corresponding to the driving signals COM1 and COM2 is stored in the memory 12 of the printer 1 or when the waveform generation information written in the memory 12 in advance is overwritten. With respect to settings, the potential information of the potential points A, B, C, D, E, and F shown in FIG. 6 may be recorded in the memory 12, together with information regarding time series. Therefore, at least the following potential information is set: potential information required for changing the potential V from the potential V1 to the micro vibration medium potential Vm defined between the potential V1 and the potential V2; potential information required for maintaining the potential V constant at the micro vibration medium potential Vm after the potential V has changed from the potential V1 to the micro vibration medium potential Vm; and potential information required for changing the potential V from the micro vibration medium potential Vm to the potential V2 after the potential V has been maintained at the micro vibration medium potential Vm are set. In this way, the generation period of the first constant potential portion N2 (the interval between the first charging portion N1 and the second charging portion N3), and the micro vibration medium potential Vm are appropriately set. Therefore, when the printer 1 is used, the amplitude or attenuation time of pressure vibration of ink in the pressure chamber 63 can be adjusted, thereby optimizing the pulse N for micro vibration.

Second Embodiment

Next, a second embodiment of the invention will be described.

In this embodiment, the same printer 1 as that in the first embodiment is used. However, in this embodiment, instead of the pulse N for micro vibration in the driving signal COM1 of the first embodiment, a pulse N' for micro vibration is generated (set). For this reason, while the configuration of the printer and the constituent elements of the printer will be omitted, the pulse N' for micro vibration will be described in detail.

Figure 9:
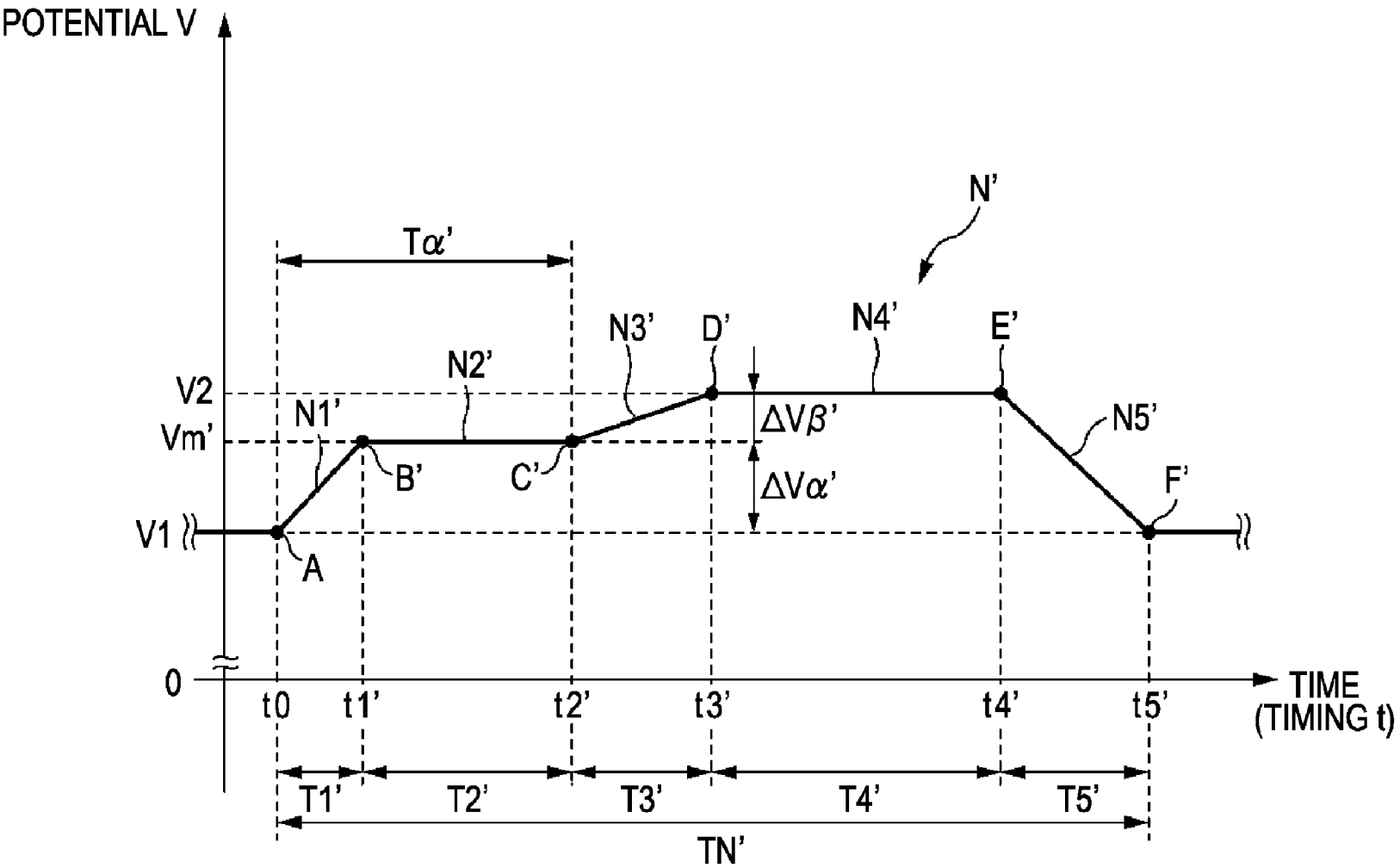
FIG. 9 is a diagram illustrating a pulse for micro vibration according to a second embodiment of the invention.
Figure 10:
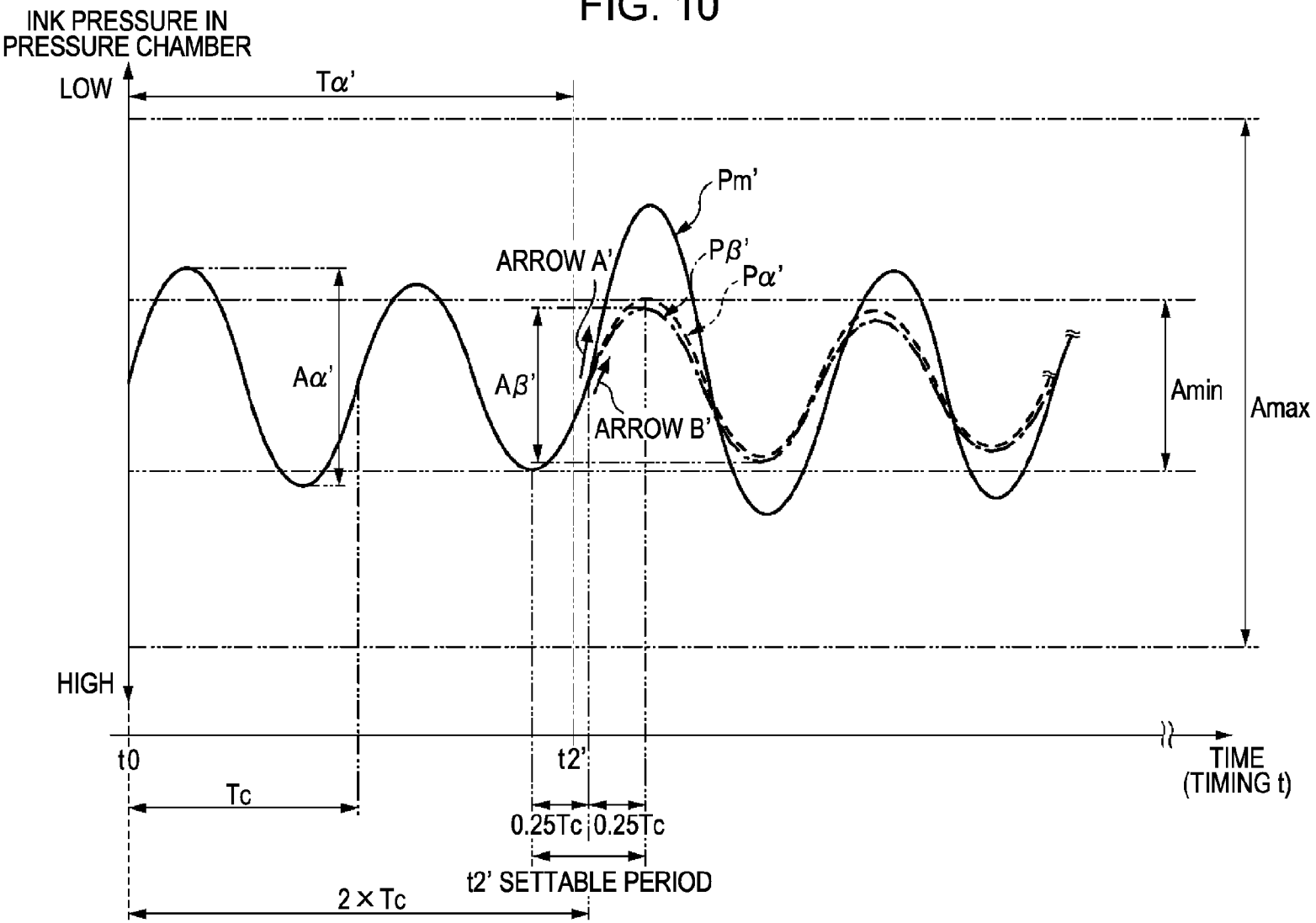
FIG. 10 is a diagram illustrating pressure vibration to be applied to ink in a pressure chamber when the pulse for micro vibration shown in FIG. 9 is applied to a piezoelectric element.

FIG. 9 is a diagram illustrating a potential change pattern of the pulse N' for micro vibration according to this embodiment. FIG. 10 is a diagram illustrating pressure vibration to be applied ink in the pressure chamber 63 when the pulse N' for micro vibration shown in FIG. 9 is applied to the piezoelectric element 61.

The pulse N' for micro vibration shown in FIG. 9 is substantially the same as the pulse N for micro vibration shown in FIG. 6, and has the same portions as those of the pulse N for micro vibration in FIG. 6. Therefore, in this embodiment, pressure vibration applied to ink due to the first charging portion N1' is excited by pressure vibration applied to ink due to the second charging portion N3'. However, the pulse N' for micro vibration has the generation start timing (excitation timing) of the second charging portion and the value (that is, the potential difference) of the micro vibration medium potential defined between the potential V1 and the potential V2 different from the pulse N for micro vibration. For this reason, excitation of a waveform starting to be attenuated is different from that described in the first embodiment.

First, the excitation timing will be described.

As shown in FIG. 10, in this embodiment, the excitation timing is timing t2'. The timing t2' is defined in a portion at which the pressure vibration waveform Pα' due to the first charging portion N1' slopes upward (during a period in which the ink pressure decreases). Therefore, the pressure vibration waveform Pβ' due to the second charging portion N3' is in phase with the pressure vibration waveform Pα' (see arrows A' and B').

As described above, since the pressure vibration waveform Pβ' is in phase with the pressure vibration waveform Pα', at the beginning of excitation immediately after the second charging portion N3' is applied to the piezoelectric element 61, pressure vibration due to the second charging portion N3' is slightly strengthened by pressure vibration due to the first charging portion N1'. In other words, the phase of the change in pressure of ink due to the second charging portion N3' is set such that the change in pressure is strengthened by pressure vibration applied to ink due to the first charging portion N1' when the second charging portion N3' starts to be applied to the piezoelectric element 61. Therefore, at the beginning of application, the pressure vibration waveform Pα' can be efficiently excited by the pressure vibration waveform Pβ'. As a result, the amplitude of the composite waveform Pm can be easily increased.

Next, the potential difference will be described.

In this embodiment, excitation by the pressure vibration waveform Pβ' starts with the timing t2'. For this reason, the maximum amplitude of the composite waveform Pm' can be defined in accordance of the potential difference ΔVβ' of the second charging portion N3'. In this embodiment, excitation is efficiently performed, and thus it is not necessary to set the potential difference ΔVβ' such that the maximum amplitude (amplitude Aβ') of the pressure vibration waveform Pβ' is larger than the maximum amplitude (amplitude Aα') of the pressure vibration waveform Pα'.

In this embodiment, the micro vibration medium potential Vm' is defined near the potential V2 such that the potential difference ΔVβ' between the micro vibration medium potential Vm' and the potential V2 is smaller than the potential difference ΔVα' between the potential V1 and the micro vibration medium potential Vm' (see FIG. 9). In this case, in order to realize a reliable ink thickening suppression effect due to the second charging portion N3', the potential difference is preferably defined such that the potential difference ΔVβ' becomes 5% or more of the potential difference (ΔVα'+ΔVβ') between the potential V2 and the potential V1, that is, the potential difference ΔVα' is within 95% of the potential difference between the potential V2 and the potential V1.

If the potential difference is set in such a manner, the amplitude of pressure vibration to be applied to ink due to each of the first charging portion N1' and the second charging portion N3' can be optimized.

Next, a way to define the timing t2' will be described.

In this embodiment, as described above, the timing t2' is defined in an upward-sloping portion in the pressure vibration waveform Pα'. The upward-sloping portion in the pressure vibration waveform Pα' is represented by Expression (4) starting with the first cycle (timing t0) of the intrinsic vibration cycle Tc.

$$mTc \pm 0.25Tc \tag{4}$$

For Expression (4), m is an integer of "0" or more. Like the above-described integer n, the range of a usable value is defined in accordance with the amplitude Amax or the range Amin.

Therefore, the timing t2' (that is, the period Ta') is defined within the period represented by Expression (4) starting with the timing t0. In the example of FIG. 10, the timing t2' is defined on an assumption that the integer m is "2". In this case, the timing t2' can be defined within the t2' settable period.

The generation start timing (timing t4') of the discharging portion N5' is defined using Expression (3), like the first embodiment.

As described above in detail, according to the second embodiment, the pulse N' for micro vibration has the first constant potential portion N2' which is generated between the generation period of the first charging portion N1' and the generation period of the second charging portion N3'. For this reason, like the first embodiment, the amplitude of the composite waveform Pm' or the attenuation time of the composite waveform Pm' can be adjusted.

According to this embodiment, the phase of the pressure vibration waveform Pβ', which is one component of the composite waveform Pm', is set such that the pressure vibration waveform Pβ' is strengthened by the pressure vibration waveform Pα', which is another component of the composite waveform Pm', immediately after composition. In other words, the phase of the change in pressure of ink due to the second charging portion N3' is set such that the change in pressure is strengthened by pressure vibration applied to the piezoelectric element 61 due to the first charging portion N1' when the second charging portion N3' starts to be applied to the piezoelectric element 61 (at the beginning of excitation). Therefore, even if pressure vibration applied to ink due to the first charging portion N1' starts to be attenuated, the pressure vibration can be efficiently excited. The timing t2' is defined within the t2' settable period, which is defined on the basis of the intrinsic vibration cycle Tc by Expression (4).

According to this embodiment, the potential difference ΔVβ' is smaller than the potential difference ΔVα'. Therefore, the amplitude of pressure vibration applied to ink due to the first charging portion N1' and the second charging portion N3' can be optimized.

Other Embodiments

Pulse for Micro Vibration

Figure 11:
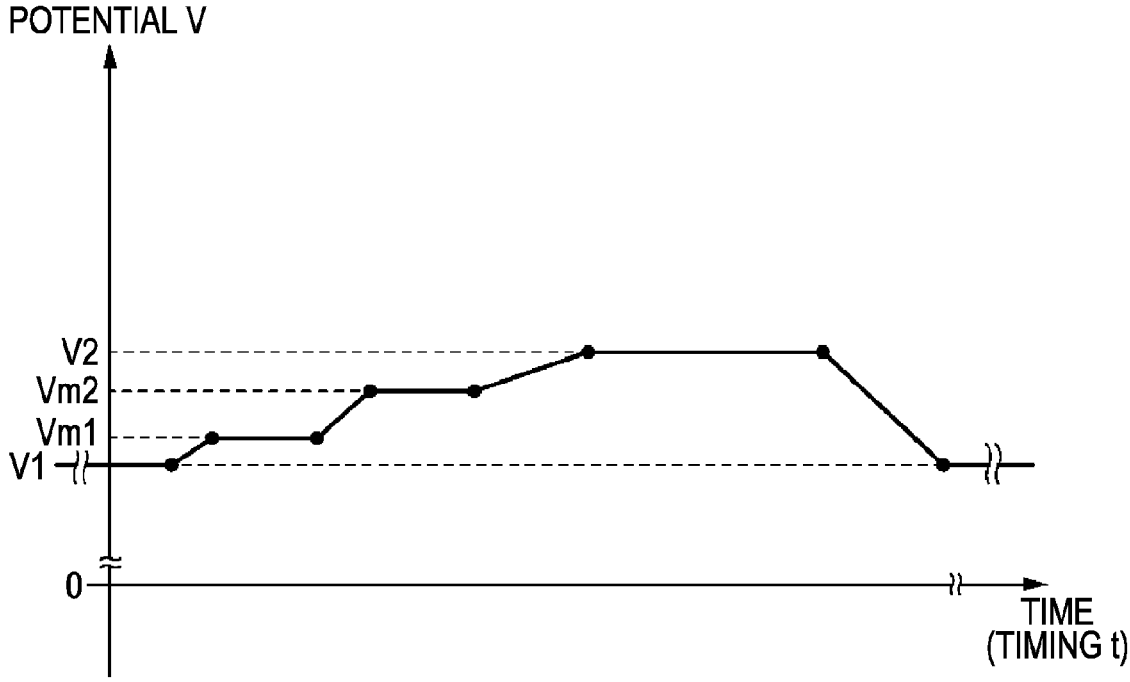
FIG. 11 is a diagram illustrating another pulse for micro vibration different from those shown in FIGS. 6 and 9.

In the foregoing first and second embodiments, the pulses N and N' for micro vibration each include the two charging portions. Alternatively, the pulse for micro vibration may include three or more charging portions. FIG. 11 shows a pulse for micro vibration having three charging portions. In this case, as shown in FIG. 11, the pulse for micro vibration preferably has a constant potential portion between two charging portions.

When the pulse for micro vibration include three or more charging portions, the excitation timing by another charging portion which is generated after one charging portion is set in the same manner as described in the foregoing first or second embodiment. For example, the excitation timing by the second charging portion is set in the same manner as described in the first embodiment (or the second embodiment), and the excitation timing by the third charging portion is set in the same manner as described in the second embodiment (or the first embodiment). The method of setting the excitation timing is not limited thereto. For example, the excitation timing by the second and third charging portions may be set in the same manner as described in the first embodiment (or the second embodiment).

Figure 12A:
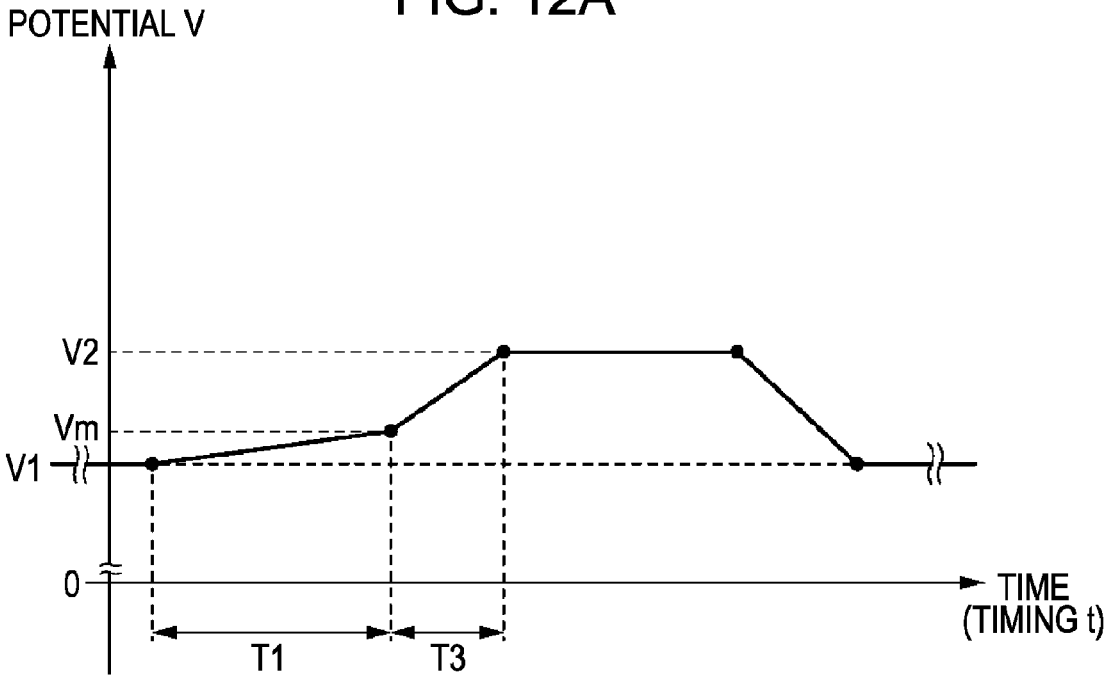
FIGS. 12A and 12B are diagrams illustrating another pulse for micro vibration different from those shown in FIGS. 6 and 9. Specifically.

In the foregoing first and second embodiments, the pulses N and N' for micro vibration each include one constant potential portion between two charging portions. Alternatively, the pulse for micro vibration may include no constant potential portion. FIG. 12A shows a pulse for micro vibration in which the constant potential portion (the first constant potential portion N2) in the pulse N for micro vibration of FIG. 6 is not provided between the two charging portions. In this way, if the pulse for micro vibration has two charging portions, the vibration of the meniscus starting to be attenuated can be excited. However, the two charging portions of the pulse for micro vibration are different in the potential change amount per unit time.

Figure 12B:
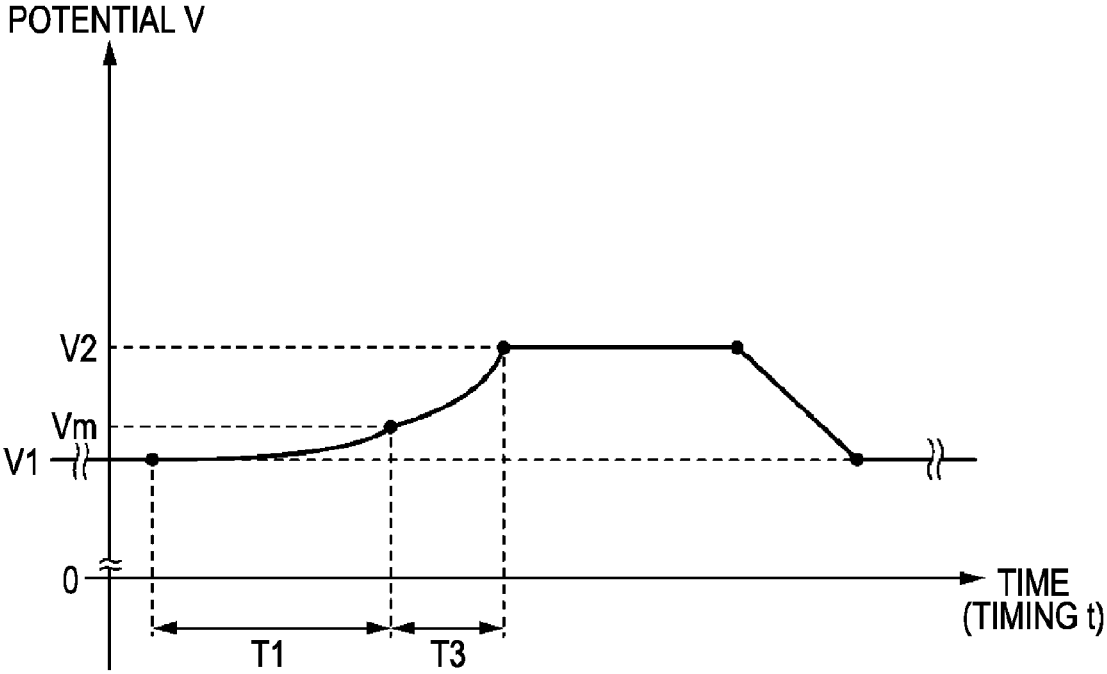

Although in the foregoing first and second embodiments, a case in which the potential change pattern of the charging portion is linear (line segment) has been described, the potential change pattern of the charging portion may be curved. FIG. 12B shows a case in which the potential change pattern of each charging portion of the pulse for micro vibration shown in FIG. 12A is curved.

Figure 13:
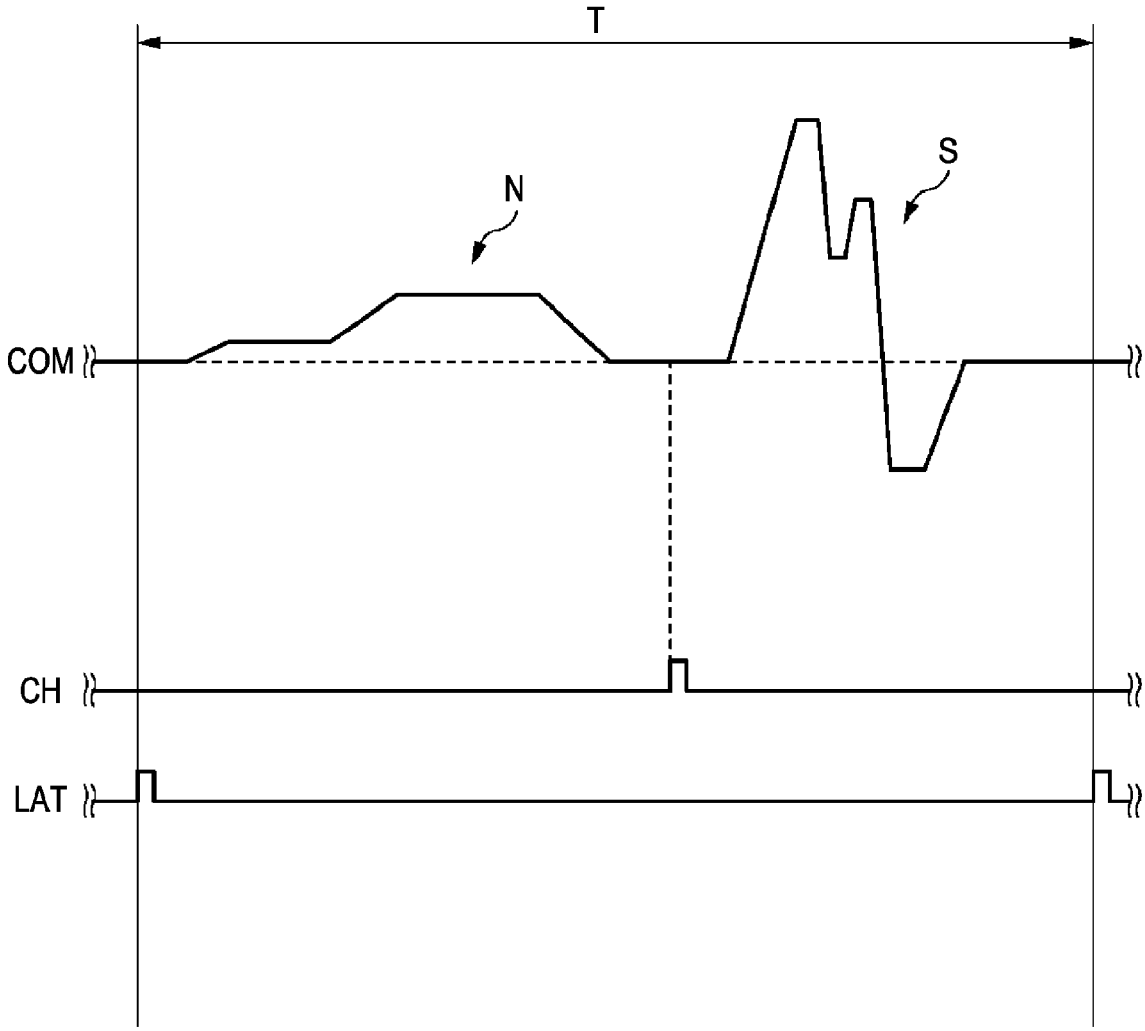
FIG. 13 is a diagram illustrating another driving signal different from that shown in FIG. 4.

Although in the foregoing first and second embodiments, the two driving signals COM1 and COM2 are generated as the driving signal, a single driving signal may be used. FIG. 13 shows a driving signal COM having the pulse N for micro vibration of the driving signal COM1 and the small dot pulse S of the driving signal COM2 shown in FIG. 4.

Although the potential V2 is higher than the potential V1, for example, by 5 V, the potential difference is not limited to 5 V. When ink is aqueous ink, the potential difference may be set to 5 V, and when ink is pigment ink or dye ink, the potential difference may be set to be in the range of 5 to 8 V. In this way, the potential difference may be appropriately changed.

In the foregoing first embodiment, the potential difference of the second charging portion is larger than the potential difference of the first charging portion. In addition, in the foregoing second embodiment, the potential difference of the second charging portion is smaller than the potential difference of the first charging portion. Alternatively, the potential difference of the second charging portion may be equal to the potential difference of the first charging portion. In this case, the pressure vibration applied to ink due to the first charging portion and the pressure vibration applied to ink due to the second charging portion have appropriate amplitude. For this reason, the excitation timing by the second charging portion may be defined within the range represented by Expression (3) or may be defined within the range represented by Expression (4).

Generation Start Timing of Discharging Portion

In the first and second embodiments, the generation start timing (timing t4 or t4') of the discharging portion is defined using the intrinsic vibration cycle Tc. Alternatively, the cycle of the pressure vibration waveform (composite waveform) defined by the generation start timing of the second charging portion may be predicted (simulation), and the generation start timing of the discharging portion may be defined using the predicted cycle (or the phase). This is because at the beginning of composition, the cycle of the composite waveform is not constant and out of the intrinsic vibration cycle Tc in accordance with the ratio of the pressure vibration waveform as a component. For example, in the case of the composite waveform Pm shown in FIG. 8B, the cycle is slightly longer than the intrinsic vibration cycle Tc (if the ratio of the pressure vibration waveform Pβ as a component increases, the cycle of the composite waveform Pm becomes identical to the intrinsic vibration cycle Tc).

Piezoelectric Element 61

The intrinsic vibration cycle of the piezoelectric element 61 is preferably shorter than the intrinsic vibration cycle Tc of pressure vibration applied to ink due to the charging portion or discharging portion of the pulse for micro vibration.

Although in the foregoing embodiments, a case in which the piezoelectric element 61 is charged and the volume of the pressure chamber 63 increases has been described, the same description is applied to a case in which the piezoelectric element 61 is discharged and the volume of the pressure chamber 63 increases.

In the foregoing embodiments, instead of the piezoelectric elements 61, for example, magnetostrictive elements may be used.

Printer 1

In the foregoing embodiments, the printer 1 ejects ink droplets from the line head 60 while transporting the sheet. However, the invention may be applied to a serial printer that performs printing while moving a head ejecting ink droplets.

Liquid Ejecting Apparatus

In the foregoing embodiments, the printer 1 in which ink is used as the liquid filled in the ink flow channel 62 including the pressure chambers 63 has been described. However, the liquid filled in the ink flow channel 62 is not limited to ink. Specific examples of the liquid ejecting apparatus include a liquid ejecting apparatus that ejects a liquid, in which a material, such as an electrode material or a color material, is dispersed or dissolved, and is used in manufacturing a liquid crystal display, an EL (Electro Luminescence) display, and a field emission display, a liquid ejecting apparatus that ejects a bioorganic material to be used in manufacturing a bio-chip, a liquid ejecting apparatus that ejects a liquid (sample) as a precision pipette. In addition, a liquid ejecting apparatus that pinpoint ejects lubricant to a precision instrument, such as a watch or a camera, a liquid ejecting apparatus that ejects on a substrate a transparent resin liquid, such as ultraviolet cure resin, to form a fine hemispheric lens (optical lens) for an optical communication element, a liquid ejecting apparatus that ejects an etchant, such as acid or alkali, to etch a substrate or the like, and a liquid ejecting apparatus that ejects gel may be used. The invention may be applied to one of the liquid ejecting apparatuses.

What is claimed is:

1. A liquid ejecting apparatus comprising:

liquid chambers in which a liquid is filled;

nozzles communicating with the liquid chambers;

a signal generator generating signals of potential change; and elements operating in accordance with the potential of the signal to be applied to cause a change in pressure of the liquid filled in the liquid chambers, wherein the signal generator generates a signal for micro vibration which causes micro vibration of a free surface of the liquid to be exposed from the nozzles to such an extent that the liquid is not ejected, and the signal for micro vibration has a first potential change portion at which a potential changes from a first potential to a medium potential defined between the first potential and a second potential, a constant potential portion which is generated after the first potential change portion and at which the potential is constant at the medium potential, and a second potential change portion which is generated after the constant potential portion and at which the potential changes from the medium potential to the second potential, wherein a duration of the second potential change portion is equal to or longer than an intrinsic vibration cycle of the elements.

2. The liquid ejecting apparatus according to claim 1, wherein a generation start timing of the second potential change portion is defined within a range represented by Expression (1) starting with a generation start timing of the first potential change portion, $$nTc+0.5Tc.+-.0.25Tc \quad (1)$$

wherein for Expression (1), n is an integer of 0 or more, and Tc is the intrinsic vibration cycle of the elements.

3. The liquid ejecting apparatus according to claim 2, wherein a difference between the medium potential and the second potential is larger than a difference between the medium potential and the first potential.

4. The liquid ejecting apparatus according to claim 1, further comprising:

a pulse generator generating pulses for defining a generation timing of the signals of potential change which causes change in pressure of the liquid filled in the liquid chambers, wherein the signals of potential change includes at least two signals of potential change, including:

a first signal having the signal for micro vibration which causes micro vibration of the free surface of the liquid without ejecting liquid, and a second signal having no signal for micro vibration and having a liquid ejection signal which causes liquid to be ejected, and one of said pulses is generated during a generation period of the constant potential portion in the signal for micro vibration.

5. A method of setting a signal for micro vibration, which is applied to elements causing a change in pressure of a liquid in liquid chambers to cause micro vibration of a free surface of the liquid to be exposed from nozzles communicating with the liquid chambers to such an extent that the liquid is not ejected, the method comprising:

setting potential information required for changing a potential from a first potential to a medium potential defined between the first potential and a second potential;

setting potential information required for, after the potential has changed from the first potential to the medium potential, maintaining the potential constant at the medium potential; and setting potential information required for, after the potential has been maintained at the medium potential changing the potential from the medium potential to the second potential, over a duration that is equal to or longer than an intrinsic vibration cycle of the elements.

* * * * *